US010837671B2

(12) United States Patent
Rockhold et al.

(10) Patent No.: US 10,837,671 B2
(45) Date of Patent: Nov. 17, 2020

(54) WIND DRIVEN RAIN PERFORMANCE, FEMA IMPACT-RATED LOUVER

(71) Applicant: Air Distribution Technologies IP, LLC, Milwaukee, WI (US)

(72) Inventors: Joseph S. Rockhold, Bates City, MO (US); Melissa M. Massar, Lee's Summit, MO (US); Christopher J. Driskell, Lee's Summit, MO (US); Josiah Wiley, Kansas City, MO (US)

(73) Assignee: Air Distribution Technologies IP, LLC, Milwaukee, WI (US)

( * ) Notice: Subject to any disclaimer, the term of this patent is extended or adjusted under 35 U.S.C. 154(b) by 16 days.

(21) Appl. No.: 15/363,979

(22) Filed: Nov. 29, 2016

(65) Prior Publication Data

US 2018/0149384 A1 May 31, 2018

(51) Int. Cl.
*F24F 13/08* (2006.01)

(52) U.S. Cl.
CPC ..... *F24F 13/082* (2013.01); *F24F 2221/52* (2013.01)

(58) Field of Classification Search
CPC ..... F24F 13/082
USPC ..... 454/277
See application file for complete search history.

(56) References Cited

U.S. PATENT DOCUMENTS 3,180,462 A * 4/1965 Grady ..... E06B 7/082 29/525
3,771,430 A * 11/1973 Lane ..... E06B 7/08 454/277
3,968,738 A * 7/1976 Matzke ..... E06B 7/082 454/309
4,103,468 A * 8/1978 Olsen ..... F24F 13/08 52/473
5,297,373 A * 3/1994 Olsen ..... E06B 7/082 52/473
5,839,244 A * 11/1998 Johnson ..... F24F 13/08 52/473
6,672,195 B1 * 1/2004 Plattner ..... B64C 1/1469 89/36.04
2010/0099349 A1 * 4/2010 Gohring ..... F24F 13/18 454/277

OTHER PUBLICATIONS

United Enertech, "ICBL-20-WR Performance Data", Feb. 2013 and revised Oct. 2013.

* cited by examiner

*Primary Examiner* — Steven B McAllister
*Assistant Examiner* — Allen R Schult
(74) *Attorney, Agent, or Firm* — Fletcher Yoder, P.C.

(57) ABSTRACT

A louver blade, comprising a first arcuate section, a second arcuate section serially connected to the first arcuate section and a hook extending from the intersection of the first arcuate section and the second arcuate section.

18 Claims, 7 Drawing Sheets

WIND DRIVEN RAIN PERFORMANCE, FEMA IMPACT-RATED LOUVER

TECHNICAL FIELD

The present disclosure relates generally to heating, ventilation and air conditioning (HVAC) equipment, and more specifically to a wind driven rain performance, FEMA impact-rated ventilation louver.

BACKGROUND OF THE INVENTION

Louvers are used to prevent egress of wind, rain, leaves, insects and other foreign materials into an HVAC system. However, existing louvers do not provide protection at levels that have been approved by the Federal Emergency Management Administration, or FEMA, and hence do not meet FEMA standards for storm-resistance.

SUMMARY OF THE INVENTION

A louver is disclosed that has louver blades that include a first arcuate section, a second arcuate section serially connected to the first arcuate section and a hook extending from the intersection of the first arcuate section and the second arcuate section. Each blade is welded into the frame to provide sufficient strength and to meet FEMA standards for storm resistance.

Other systems, methods, features, and advantages of the present disclosure will be or become apparent to one with skill in the art upon examination of the following drawings and detailed description. It is intended that all such additional systems, methods, features, and advantages be included within this description, be within the scope of the present disclosure, and be protected by the accompanying claims.

BRIEF DESCRIPTION OF THE SEVERAL VIEWS OF THE DRAWINGS

Aspects of the disclosure can be better understood with reference to the following drawings. The components in the drawings may be to scale, but emphasis is placed upon clearly illustrating the principles of the present disclosure. Moreover, in the drawings, like reference numerals designate corresponding parts throughout the several views, and in which.

DETAILED DESCRIPTION OF THE INVENTION

Figure 1:
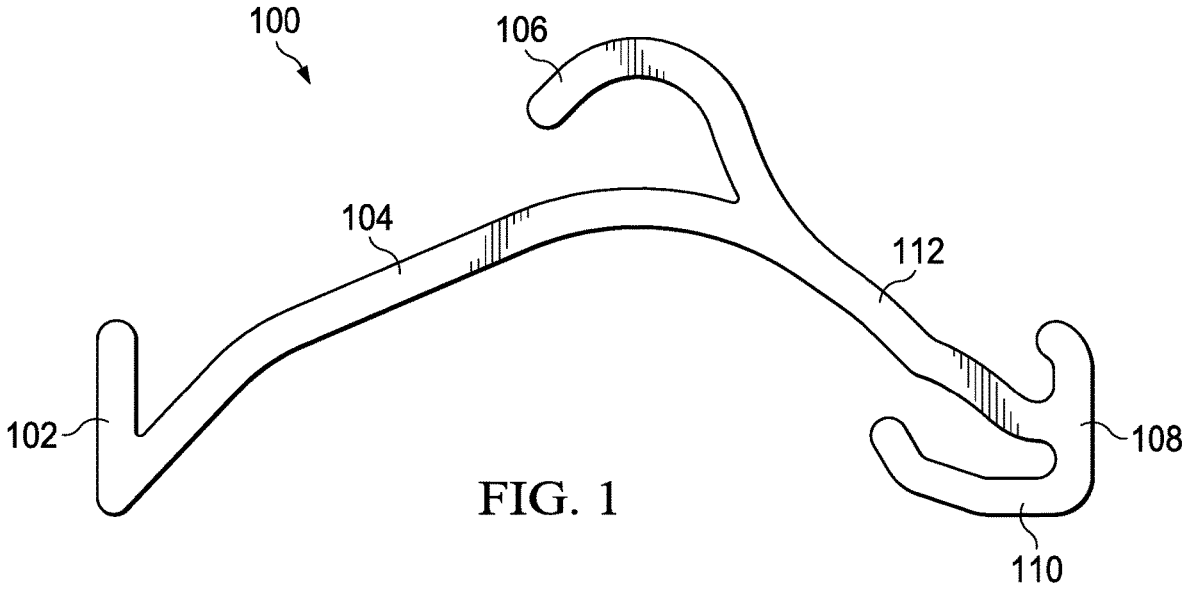
FIG. 1 is a diagram of a louver blade that provides wind driven rain performance that meets FEMA impact ratings, in accordance with an exemplary embodiment of the present disclosure.

In the description that follows, like parts are marked throughout the specification and drawings with the same reference numerals. The drawing figures may be to scale and certain components can be shown in generalized or schematic form and identified by commercial designations in the interest of clarity and conciseness.

FIG. 1 is a diagram of a louver blade 100 that provides wind driven rain performance that meets FEMA impact ratings, in accordance with an exemplary embodiment of the present disclosure. Louver blade 100 can be formed from aluminum, steel, other metals, polymers, composite materials, composite structures or other suitable materials.

Louver blade 100 includes front shield 102, which extends upwards from arcuate member 104 for a distance D1 at a first angle A. Arcuate member 104 has a first bend B and a second bend with inner radius D and outer radius E. Hook 106 extends from arcuate member 104 a distance D4 at angle C, and has an inner radius G and an outer radius H. Arcuate member 104 intersects serially with arcuate member 112, which has a bend with radius F. End pieces 108 and 110 extend from the end of arcuate member 112, to form a first enclosed space 114 and a second enclosed space 116. The overall length of louver blade 100 is D2 from front shield 102 to end piece 108, and D3 from the end of hook 106 to end piece 108. Louver blade 100 has a height of D5 from end piece 110 to hook 106. While FIG. 1 is not limited to any specific scale, the relative dimensions shown are exemplary, such that one of ordinary skill in the art would understand that D1 is approximately the same length as D4, and that D1 and D4 are each less than any one of D2, D3 and D5, and also that D2 is greater than either of D3 or D5.

FEMA requirements include impact resistance, wind driver rain performance, as well as other criteria. The present disclosure provides a louver blade that has been tested to meet both the wind driven rain performance and FEMA impact. For example, the present disclosure has been tested to successfully withstand the impact of a wooden structural member having dimensions 2" by 4" and with various lengths at speeds of 100 MPH, and can also remove water from a simulated 8" per hour rainfall at 50 MPH wind.

Figure 2:
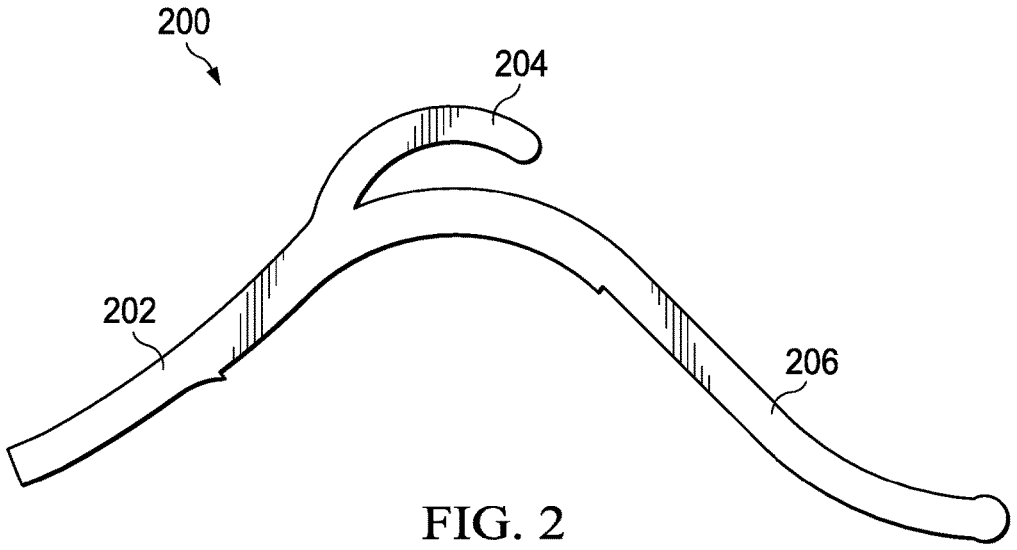
FIG. 2 is a diagram of a louver blade that provides wind driven rain performance that meets FEMA impact ratings, in accordance with an exemplary embodiment of the present disclosure.

FIG. 2 is a diagram of a louver blade 200 that provides wind driven rain performance that meets FEMA impact ratings, in accordance with an exemplary embodiment of the present disclosure. Louver blade 200 can be formed from aluminum, steel, other metals, polymers, composite materials, composite structures or other suitable materials.

Louver blade 200 includes arcuate section 202, which intersects with hook 204 and arcuate section 206. Arcuate section 206 has a radius of curvature R2 at the point of intersection with arcuate section 202, and hook 204 has a radius of curvature of R1. Arcuate section 206 has a radius of curvature R3 at the end of louver 202 opposite arcuate section 202. Louver blade 200 has an overall length L1, and a height H1.

Figure 3B:
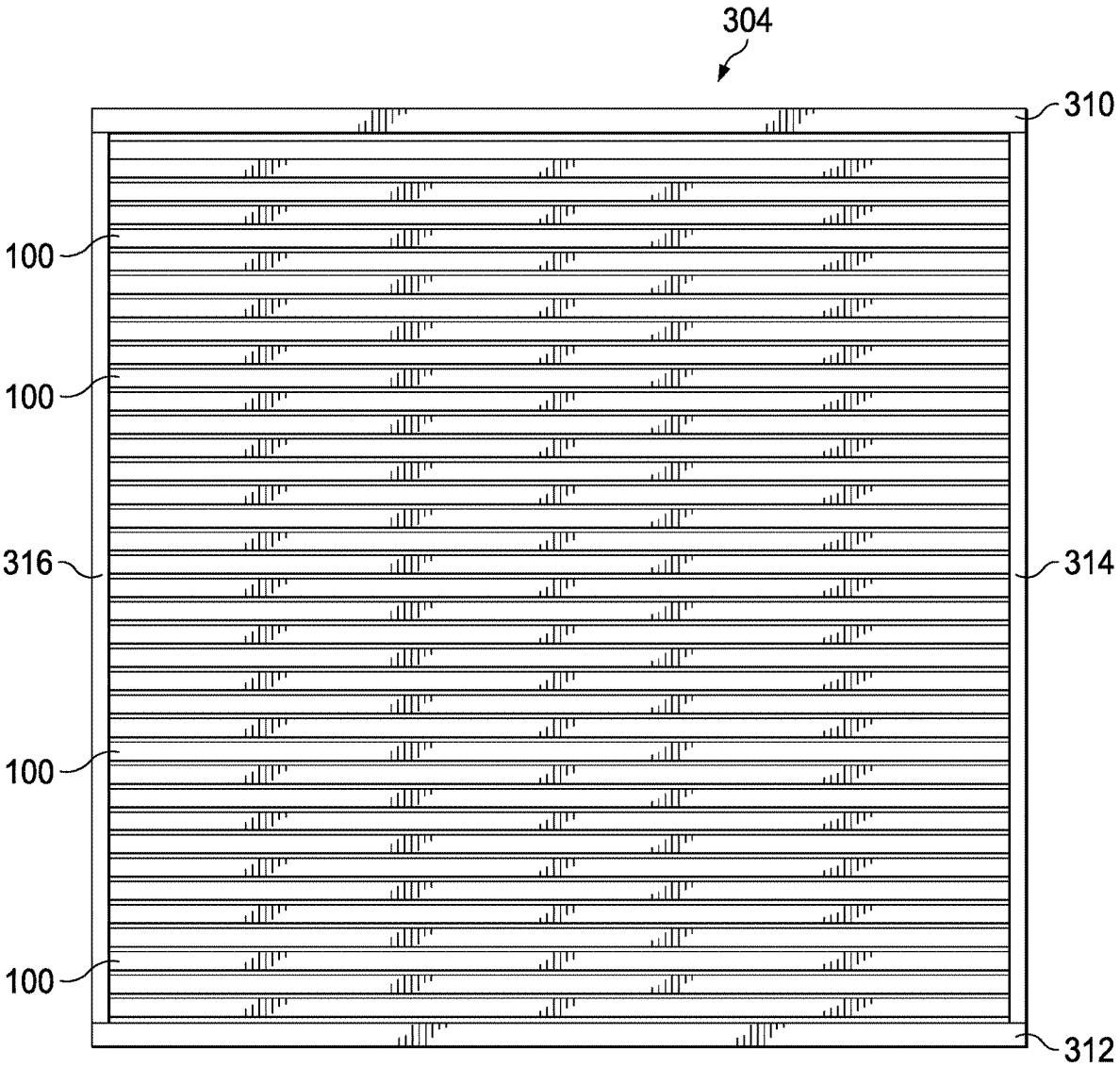
FIGS. 3A through 3D are diagrams of a louver formed from impact and water resistant louver blades, in accordance with an exemplary embodiment of the present disclosure.
Figure 3A:
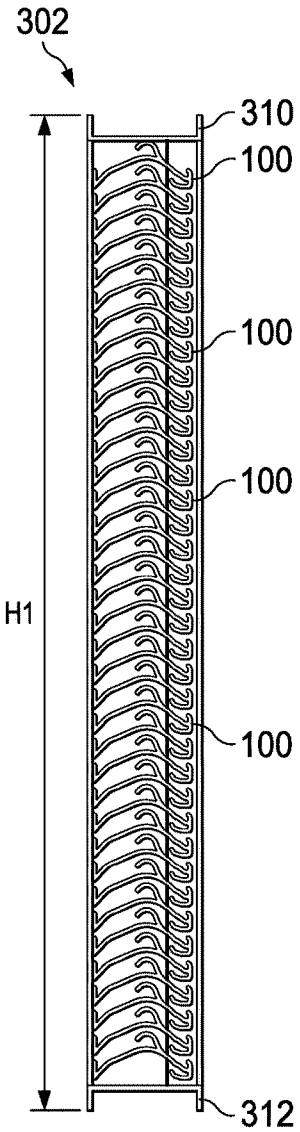
Figure 3C:
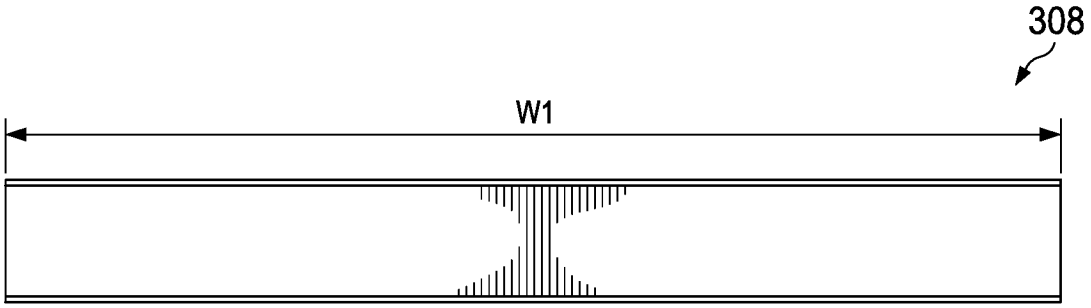
Figure 3D:
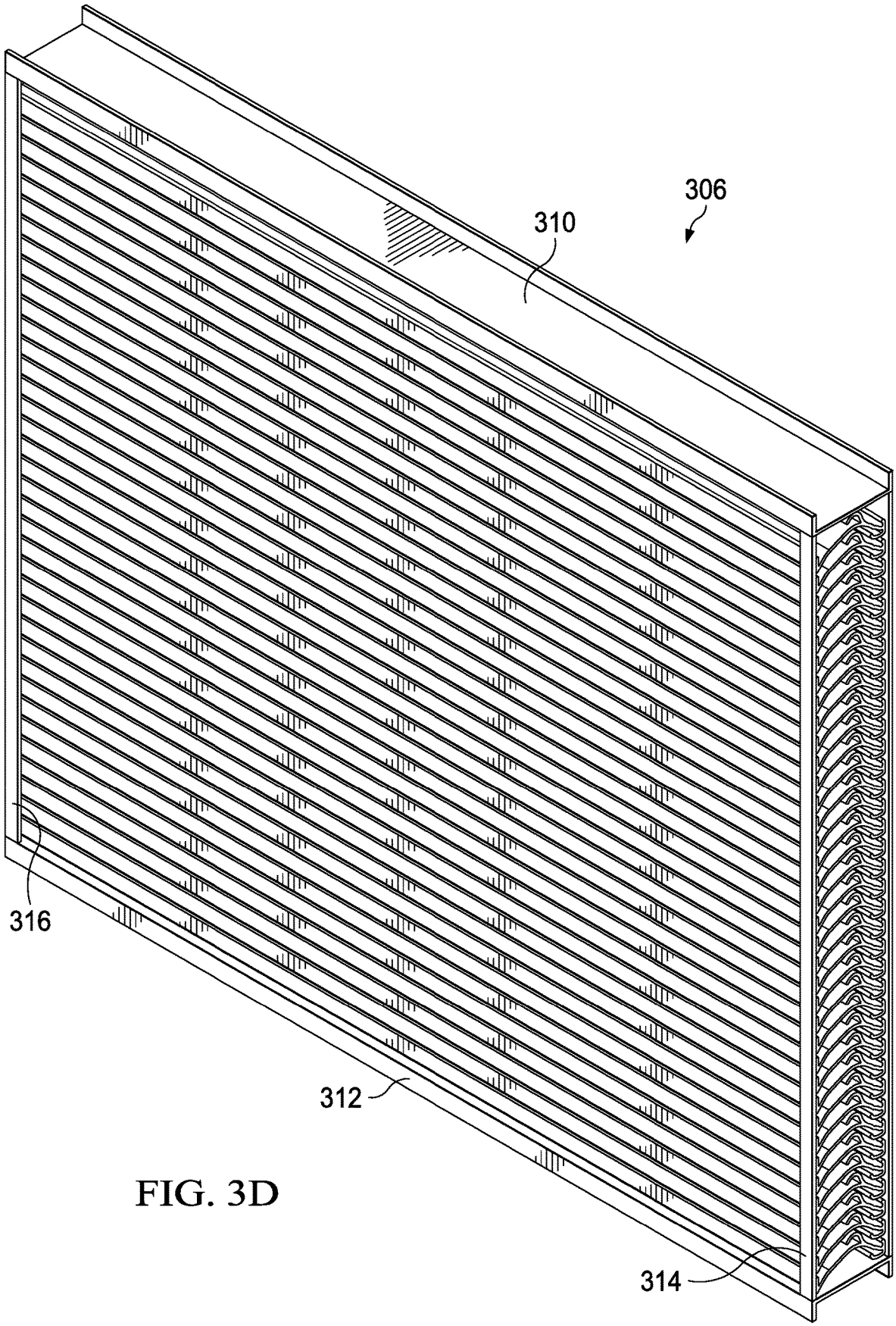

FIGS. 3A through 3D are diagrams of a louver 300 formed from impact and water resistant louver blades 100, in accordance with an exemplary embodiment of the present disclosure. FIG. 3A is a side view showing louver side 302, which has a stacked configuration of louver blades 100 that provides both impact resistance and water resistance, and which has an overall height H1. FIG. 3B is a front view showing louver front 304 and outer frame sections 310, 312, 314 and 316, with a plurality of louver blades 100, although louver blades 200 can also or alternatively be used. FIG. 3C is a top view showing louver top 308 having a width W1. FIG. 3D is an orthogonal view 306 that also shows louver top 310, louver bottom 312, louver sides 314 and 316 and louver blades 100.

Figure 4C:
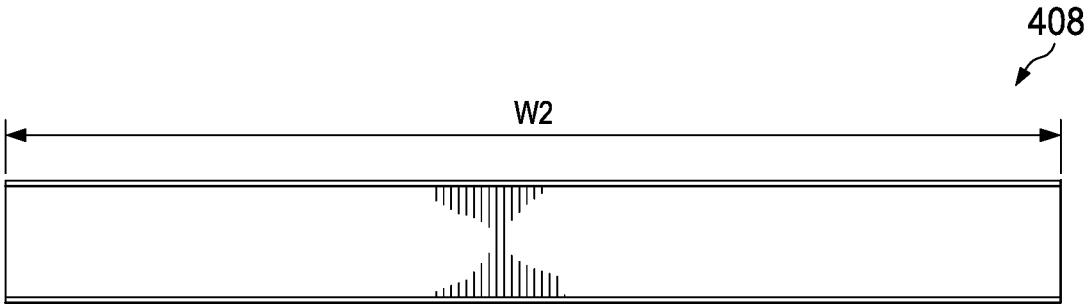
FIGS. 4A through 4D are diagrams of a louver formed from impact and water resistant louver blades, in accordance with an exemplary embodiment of the present disclosure.
Figure 4B:
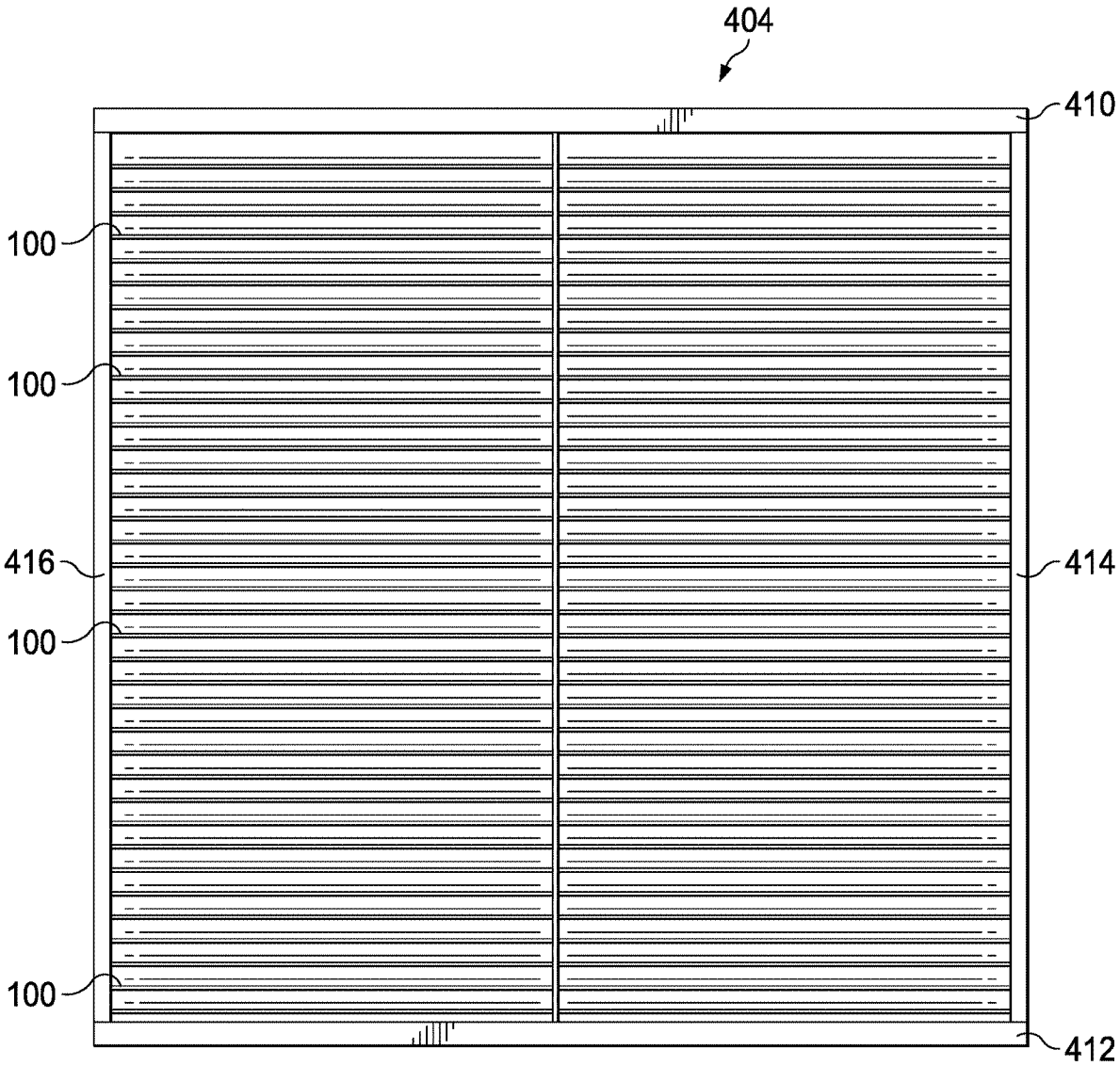
Figure 4A:
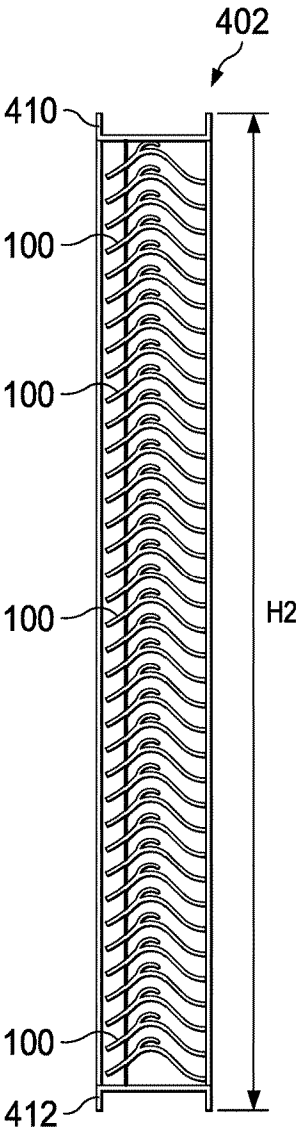
Figure 4D:
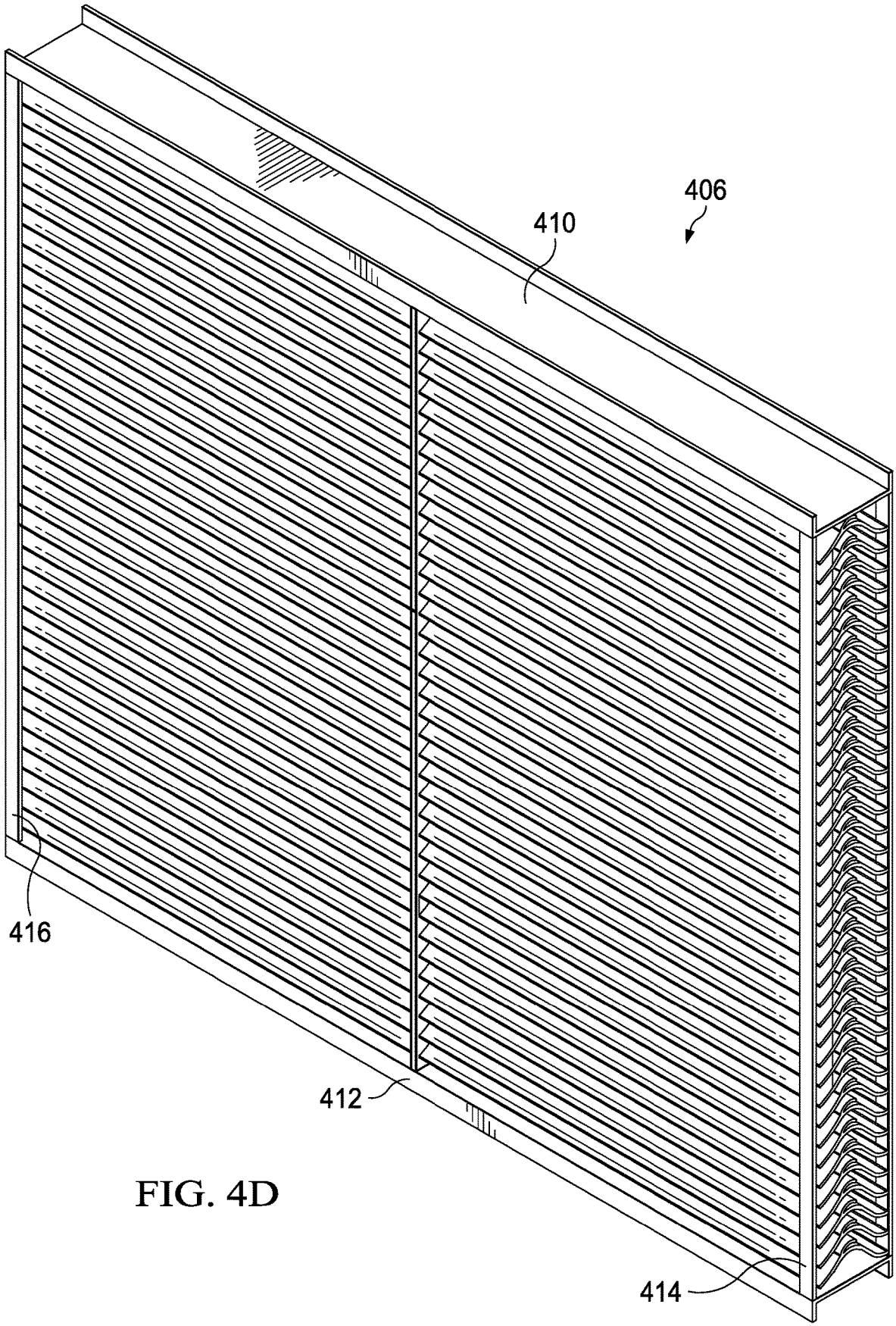

FIGS. 4A through 4D are diagrams of a louver 400 formed from impact and water resistant louver blades 200, in accordance with an exemplary embodiment of the present disclosure. FIG. 4A is a side view showing louver side 402, which has a stacked configuration of louver blades 200 that provides both impact resistance and water resistance, and which has an overall height H2. FIG. 4B is a front view showing louver front 404 and outer frame sections 410, 412, 414 and 416, with a plurality of louver blades 200, although louver blades 100 can also or alternatively be used. FIG. 4C is a top view showing louver top 408 having a width W2. FIG. 4D is an orthogonal view 406 that also shows louver top 410, louver bottom 412, louver sides 414 and 416 and louver blades 200.

Figure 5:
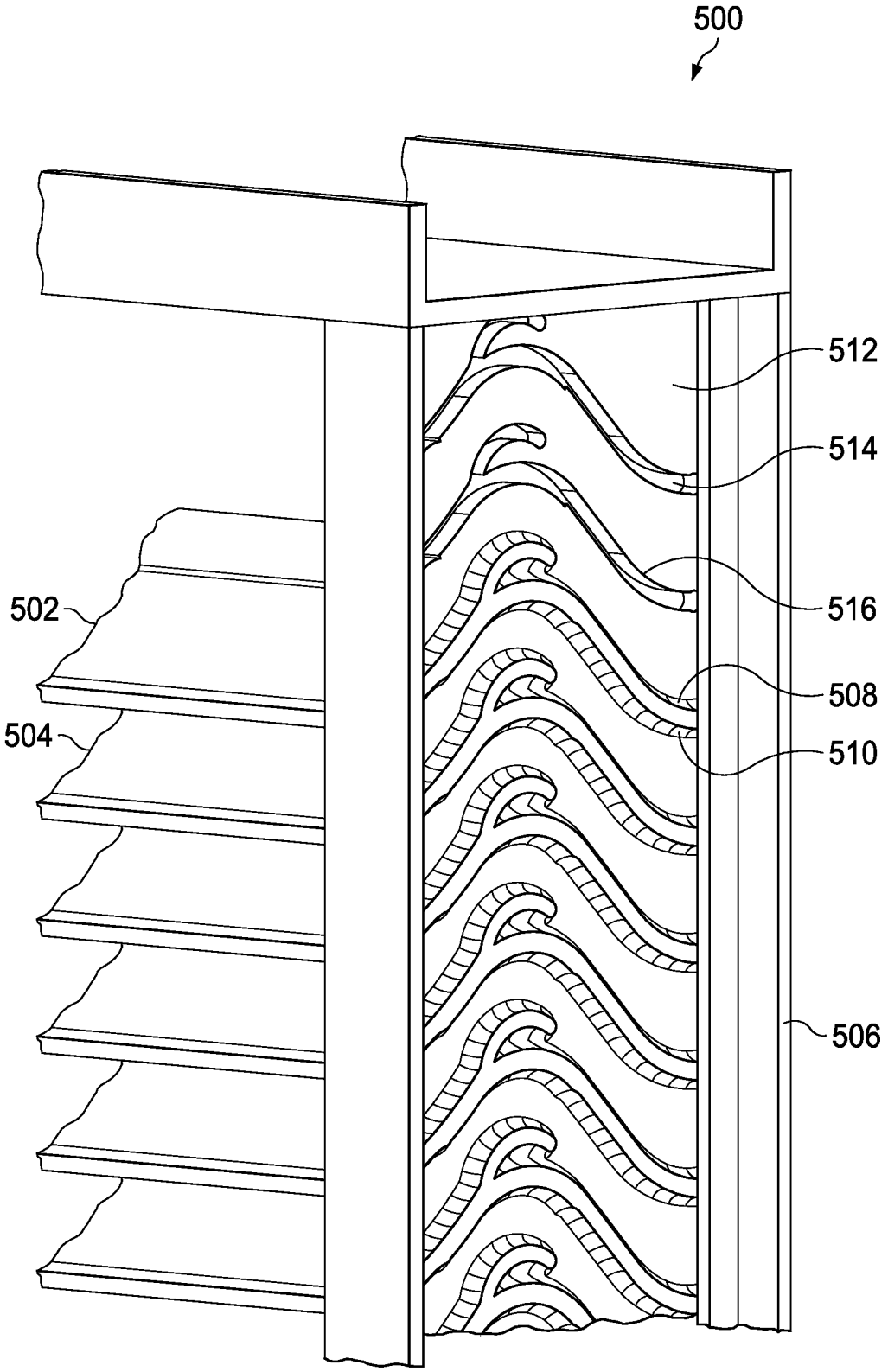
FIG. 5 is a diagram of a welding detail for a louver formed from impact and water resistant louver blades, in accordance with an exemplary embodiment of the present disclosure.

FIG. 5 is a diagram of a welding detail 500 for a louver formed from impact and water resistant louver blades, in accordance with an exemplary embodiment of the present disclosure. Welding detail 500 includes louver blades 502 and 504, which are each inserted into a slot, such as slot 514 or slot 516 on either side of the louver frame 506, such as in frame side 512. After the louver blades 502 and 504 are inserted into the slot, a top weld 508 and bottom weld 510 is applied to the frame side and louver blade, such as by arc welding, electroslag welding, oxy acetylene welding, or in other suitable manners. Each blade extends at least 0.010" from the slot, and ideally extends between 0.010" and 0.50" from the slot, depending on the type of weld, lock, seal or other process that is used to secure the blade into the slot. The weld can be manually applied, applied using robotic processes or otherwise suitably applied. In addition to a weld, other suitable materials or structures can be used. In one exemplary embodiment, each louver blade can be welded after it is inserted into the associated slot and before the next adjacent louver blade is inserted. In another exemplary embodiment, each louver blade can be inserted in a first process, and then the assembled frame with louver blades can be transferred to a welding bay for application of top weld 508 and then bottom weld 510 on each blade. In another exemplary embodiment, the top welds 508 for each louver blade can be applied in a single process, and then the bottom welds 510 for each blade can be applied. The blades can also or alternatively be held in position using adhesive, clips, a brace or other suitable devices until welding can be applied. Welding is used to provide a durable connection between the louver blades and the frame to ensure that the assembled louver will provide sufficient impact and water resistance. In another exemplary embodiment, alternating louver blades can be welded and other connection processed can be used on the remaining louver blades, in order to reduce costs.

In one exemplary embodiment, a louver is disclosed that includes a frame and a plurality of louver blades disposed within the frame. One or more louver blades has a first arcuate section, a second arcuate section serially connected to the first arcuate section and a hook extending from the intersection of the first arcuate section and the second arcuate section. The first arcuate section of one or more louver blade can comprise a straight portion extending from an end of the first arcuate section at an angle. One or more louver blade can alternatively comprise an end section extending from an end of the second arcuate section. One or more louver blades can also include a first end section extending from an end of the second arcuate section and a second end section extending from the end of the second arcuate section. The hook of one or more louver blade extends from the intersection of the first arcuate section and the second arcuate section at an angle that is less than 90 degrees. One or more of the louver blades can further comprise a first end section extending from an end of the second arcuate section to form an enclosed space and a second end section extending from the end of the second arcuate section. One or more of the louver blades can further comprise a first end section extending from an end of the second arcuate section to form a first enclosed space and a second end section extending from the end of the second arcuate section to form a second enclosed space. The hook of one or more of the louver blades further comprises a circular radius bend. The louver blades are inserted into slots in a side structure of the frame and are then welded into position, to provide a durable accretive structure that is strengthened by each louver blade.

As used herein, the singular forms "a", "an" and "the" are intended to include the plural forms as well, unless the context clearly indicates otherwise. It will be further understood that the terms "comprises" and/or "comprising," when used in this specification, specify the presence of stated features, integers, steps, operations, elements, and/or components, but do not preclude the presence or addition of one or more other features, integers, steps, operations, elements, components, and/or groups thereof. As used herein, the term "and/or" includes any and all combinations of one or more of the associated listed items. As used herein, phrases such as "between X and Y" and "between about X and Y" should be interpreted to include X and Y. As used herein, phrases such as "between about X and Y" mean "between about X and about Y." As used herein, phrases such as "from about X to Y" mean "from about X to about Y."

It should be emphasized that the above-described embodiments are merely examples of possible implementations. Many variations and modifications may be made to the above-described embodiments without departing from the principles of the present disclosure. All such modifications and variations are intended to be included herein within the scope of this disclosure and protected by the following claims.

What is claimed is:

1. A louver blade having a cross-section, the cross-section comprising:

a first arcuate section comprising a proximal end and a distal end disposed opposite the proximal end;

a second arcuate section comprising an additional proximal end serially connected to the proximal end of the first arcuate section and an additional distal end disposed opposite the proximal end of the first arcuate section and the additional proximal end of the second arcuate section;

a hook extending from an intersection between the proximal end of the first arcuate section and the additional proximal end of the second arcuate section along a hook-side surface of the louver blade;

a first end piece extending from an end point of the additional distal end of the second arcuate section along the hook-side surface;

a second end piece extending from the end point of the additional distal end of the second arcuate section along a surface of the louver blade opposing the hook-side surface, wherein the first end piece comprises a first length that is shorter than a second length of the second end piece; and a straight portion extending from an end point of the distal end of the first arcuate section at an angle along the hook-side surface.

2. The louver blade of claim 1, wherein the hook extends from the intersection between the proximal end of the first arcuate section and the additional proximal end of the second arcuate section at an angle that is less than 90 degrees.

3. The louver blade of claim 1, wherein the first end piece is angled toward the second arcuate section to form a first partially enclosed space therebetween.

4. The louver blade of claim 3, wherein the second end piece is angled toward the second arcuate section to form a second partially enclosed space therebetween.

5. The louver blade of claim 1, wherein the hook further comprises a circular radius bend.

6. The louver blade of claim 1, wherein the hook-side surface comprises, extending therefrom, only the first end piece, the hook, and the straight portion.

7. A louver, comprising:

a frame comprising a frame section member and a plurality of slots defined through the frame section member; and a plurality of louver blades disposed within the frame, wherein each louver blade of the plurality of louver blades comprises a longitudinal end disposed through and within a corresponding slot of the plurality of slots from an inward-facing surface of the frame section member to an outward-facing surface of the frame section member, wherein each louver blade is fixed within the corresponding slot via a weld between the longitudinal end of each louver blade and the outward-facing surface of the frame section member, and wherein a cross-section that is a part of the longitudinal end of each louver blade comprises:

a first arcuate section;

a second arcuate section comprising a proximal end serially connected to the first arcuate section and a distal end disposed opposite the proximal end; and a hook extending from an intersection between the first arcuate section and the proximal end of the second arcuate section, wherein the cross-section comprising the first arcuate section, the second arcuate section, and the hook extends unchanged from the longitudinal end to an opposing longitudinal end of each louver blade of the plurality of louver blades.

8. The louver of claim 7, wherein the first arcuate section of the cross-section of each louver blade comprises:

a proximal end of the first arcuate section serially connected to the proximal end of the second arcuate section; and a distal end of the first arcuate section disposed opposite the proximal end of the first arcuate section; and wherein the cross-section of each louver blade further comprises a straight portion extending from an end point of the distal end of the first arcuate section at an angle.

9. The louver of claim 8, wherein the hook and the straight portion of the cross-section of each louver blade extend from a hook-side surface of the louver blade.

10. The louver of claim 7, wherein the cross-section of each louver blade further comprises:

a first end piece extending from an end point of the distal end of the second arcuate section; and a second end piece extending from the end point of the distal end of the second arcuate section.

11. The louver of claim 7, wherein the hook of the cross-section of each louver blade extends from the intersection of the first arcuate section and the proximal end of the second arcuate section at an angle that is less than 90 degrees.

12. The louver of claim 7, wherein the cross-section of each louver blade further comprises:

a first end piece extending upward from an end point of the distal end of the second arcuate section to form a first partially enclosed space; and a second end piece extending downward from the end point of the distal end of the second arcuate section to form a second partially enclosed space.

13. The louver of claim 12, wherein the first end piece comprises a first length that is shorter than a second length of the second end piece.

14. The louver of claim 13, wherein the hook and the first end piece of the cross-section of each louver blade extend from a hook-side surface of each louver blade, and wherein the second end piece of the cross-section of each louver blade extends from a surface of each louver blade opposing the hook-side surface.

15. A louver, comprising:

a frame, comprising:

a first frame section member having a first plurality of slots defined therethrough; and a second frame section member having a second plurality of slots defined therethrough; and a plurality of louver blades extending between the first frame section member and the second frame section member, wherein each louver blade of the plurality of louver blades comprises:

a first longitudinal end disposed through a corresponding first slot of the first plurality of slots, wherein the first longitudinal end of each louver blade is fixed into the corresponding first slot via a first weld between the first longitudinal end of each louver blade and a first outward-facing surface of the first frame section member;

a second longitudinal end disposed through a corresponding second slot of the second plurality of slots, wherein the second longitudinal end of each louver blade is fixed into the corresponding second slot via a second weld between the second longitudinal end of each louver blade and a second outward-facing surface of the second frame section member; and a cross-section defined at the first longitudinal end, the second longitudinal end, or both, comprising:

a first arcuate section;

a second arcuate section serially connected to the first arcuate section; and a hook extending from an intersection between the first arcuate section and the second arcuate section;

wherein the cross-section comprising the first arcuate section, the second arcuate section, and the hook extends unchanged from the first longitudinal end to the second longitudinal end of each louver blade of the plurality of louver blades.

16. The louver of claim 15, wherein the cross-section of each louver blade further comprises:

a first end piece extending from a distal end point of the second arcuate section; and a second end piece extending from the distal end point of the second arcuate section.

17. The louver of claim 15, wherein the cross-section of each louver blade further comprises a straight portion extending from a distal end point of the first arcuate section at an angle.

18. The louver of claim 15, wherein the frame comprises:

a top frame section member coupled between a first end of the first frame section member and a first end of the second frame section member; and a bottom frame section member coupled between a second end of the first frame section member and a second end of the second frame section member, wherein the top frame section member, the bottom frame section member, and the plurality of louver blades each extend along a horizontal axis.

* * * * *